US007054591B1

(12) United States Patent
Wilhelm et al.

(10) Patent No.: US 7,054,591 B1
(45) **Date of Patent: *May 30, 2006**

(54) ELECTROPHOTOGRAPHIC DEVICE WITH AN ARRANGEMENT FOR TRANSFERRING USED TONER FROM A CLEANING STATION TO A USED TONER CONTAINER

(75) Inventors: Blasius Wilhelm, Neusaess (DE); Georg Boehmer, Munich (DE); Karl-Heinz Jenak, Munich (DE); Joseph Knott, Tutzing (DE); Peter Bremmer, Roehrmoos (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/284,563

(22) PCT Filed: Oct. 15, 1997

(86) PCT No.: PCT/DE97/02385

§ 371 (c)(1),
(2), (4) Date: May 1, 2000

(87) PCT Pub. No.: WO98/16876

PCT Pub. Date: Apr. 23, 1998

(30) Foreign Application Priority Data

Oct. 15, 1996 (DE) ..... 196 42 570

(51) Int. Cl.
*G03G 21/12* (2006.01)

(52) U.S. Cl. ..... 399/360

(58) Field of Classification Search ..... 399/120, 399/359, 360

See application file for complete search history.

(56) References Cited

U.S. PATENT DOCUMENTS

| | | | | |
|---|---|---|---|---|
| 4,313,674 | A * | 2/1982 | Ura et al. | 399/360 |
| 4,833,501 | A | 5/1989 | Büyükgüclu | |
| 4,967,234 | A | 10/1990 | Tani et al. | |
| 5,309,211 | A | 5/1994 | Yoshioka | |
| 5,329,340 | A | 7/1994 | Fukuchi et al. | |
| 5,398,098 | A * | 3/1995 | Fukunaga et al. | |
| 5,710,960 | A * | 1/1998 | Hart et al. | 399/359 |
| 5,848,343 | A * | 12/1998 | Takahashi et al. | 399/359 |
| 5,857,129 | A * | 1/1999 | Harris | 399/120 |
| 6,041,212 | A * | 3/2000 | Okada | 399/359 |
| 6,229,975 | B1 * | 5/2001 | Wilhelm et al. | 399/120 |

FOREIGN PATENT DOCUMENTS

| | | |
|---|---|---|
| DE | 33 43 910 | 6/1984 |
| DE | 35 12 060 | 10/1985 |
| DE | 35 31 775 | 3/1986 |
| DE | 39 21 806 | 1/1991 |
| EP | 0 308 431 | 3/1990 |
| JP | 59-22069 | 2/1984 |
| JP | 61-166565 | 7/1986 |
| JP | 62-98374 | 5/1987 |
| JP | 4-182678 | 6/1992 |
| JP | 5-45955 | 2/1993 |
| JP | 5-188779 | 7/1993 |
| JP | 8-152751 | 6/1996 |

* cited by examiner

*Primary Examiner*—Susan Lee
(74) *Attorney, Agent, or Firm*—Schiff Hardin LLP

(57) ABSTRACT

A device for the electrophotographic production of image patterns has at least one printing unit to which toner is supplied and has an arrangement for transferring used toner from a cleaning station of the printing unit to a used toner container. The arrangement for transferring can be interrupted to enable changing the used toner container without interrupting the printing operation of the device.

29 Claims, 18 Drawing Sheets

| F | M | Zustand |
|---|---|---|
| 0 | 0 | Z1 |
| 0 | 1 | Z2 |
| 1 | 0 | Z3 |
| 1 | 1 | Z4 |

Fig. 19

ELECTROPHOTOGRAPHIC DEVICE WITH AN ARRANGEMENT FOR TRANSFERRING USED TONER FROM A CLEANING STATION TO A USED TONER CONTAINER

CROSS-REFERENCE TO RELATED APPLICATION

This application is a National Stage filed under 35 USC 371 of PCT/DE97/02385, filed Oct. 15, 1997, which claimed priority from German Application 196 42 570.0 filed Oct. 15, 1996.

BACKGROUND OF THE INVENTION

The invention is directed to a device for the electrographic generation of image patterns on a recording medium, particularly printer or copier, having at least one printing unit to which toner is supplied from a toner reservoir. According to various aspects of the invention, the invention is directed to means for delivering the toner and/or for eliminating the toner in such a device.

When the toner's supply in the toner reservoir in a known printer is running out, a signal is generated that causes the printer to be arrested or stopped. An operator must then refill toner from a standardized refilling container into the toner reservoir. After the end of the filling procedure, printing operations can be re-assumed. A similar case applies for handling used toner that is collected from a cleaning station in the printer or copier. When a used toner container has reached a high filling level, an operator is informed of this with an alarm signal. Printing operations are interrupted and the full used toner container is replaced with an empty one. The described procedure reduces the availability, economic feasibility and user-friendliness of the printer or, respectively, copier. This is felt particularly given high-performance printers that should print or, respectively, copy optimally interruption-free in order to achieve their full efficiency.

U.S. Pat. No. 5,329,340 discloses an apparatus for the electrophotographic generation of image patterns on a recording medium. The apparatus contains two toner reservoirs. When the first toner reservoir is empty, a switch is made to the second toner reservoir. The used toner that arises is collected in a used toner container. When the used toner container is not available, the used toner is collected in an additionally provided container inside the apparatus or outside the apparatus.

DE-A-39 21 806 discloses a dry copier device wherein the excess toner is collected in a collecting container that is arranged outside the copier device. The collecting container is connected to the copier device with a conveyor conduit. The conveyor conduit contains a downpipe, so that the toner is further-conveyed due to the influence of gravity. The elimination of the toner in the direction of the collecting container ensues with the assistance of a worm conveyor.

U.S. Pat. No. 4,967,234 discloses a copier device whose device covers, for example device doors, are connected to an electrical safety means. When the device doors are opened, the copier device is shut off by this safety device. An opening that is not connected to the safety device is incorporated into the device cover. A toner container with fresh toner can be supplied to the copier device via this opening. The fresh toner is refilled into a container. The toner container emptied in this way is then filled with used toner.

U.S. Pat. No. 5,309,211 describes a laser printer. The used toner output by a cleaning station is conveyed to a used toner container with the assistance of an intermittently operating worm conveyor.

SUMMARY OF THE INVENTION

An object of the invention is to specify a device for the electrographic generation of image patterns on a recording medium wherein the apparatus operation is as continuous as possible. In particular, it is an object of the invention to enable the continuous elimination of used toner without interruption of apparatus operations.

This object is achieved by an improvement in an apparatus for electrographically producng image patterns on a recording medium, such as a printer or copier, which apparatus comprises at least one printing unit to which toner is supplied from a toner reservoir and has means for elimination of used toner collected at the cleaning station by transferring the used toner to a used toner container. The improvement is that the means is interruptible to allow replacing or changing of the used toner container without interrupting the printing operation and the means has a controllable coupling that can be actuated between a drive and conveyor shaft for the transfer of the toner from the cleaning station.

According to an exemplary embodiment of the invention, an opening is provided in a device cover through which the toner reservoir can be refilled from the outside without interrupting operations. In particular, a closeable opening through which the toner reservoir can be refilled is provided in the apparatus store in the region of a filling opening of the toner reservoir. For safety reasons, the device door can be connected to an electrical safety means that interrupts operation of the device when the device door is opened. In order to be nonetheless able to refill toner, an opening can be inserted in this device door whose condition, i.e. whether open or closed, is not evaluated for the operation of the printer. The toner reservoir can then be filled through this closeable opening. An opening of the device door with the result that the security means shuts the device off is not required.

As a result of the invention, an electrophotographic device can work interruption-free with high efficiency, even when the toner consumption is extremely high.

Exemplary embodiments of the invention are explained below with reference to the drawing. In this explanation, further features of various aspects of the invention, advantageous effects and the combination of inventive features are described.

BRIEF DESCRIPTION OF THE DRAWINGS

FIG. 19 is a diagram for defining various operating conditions;

DESCRIPTION OF THE PREFERRED EMBODIMENTS

Figure 1:
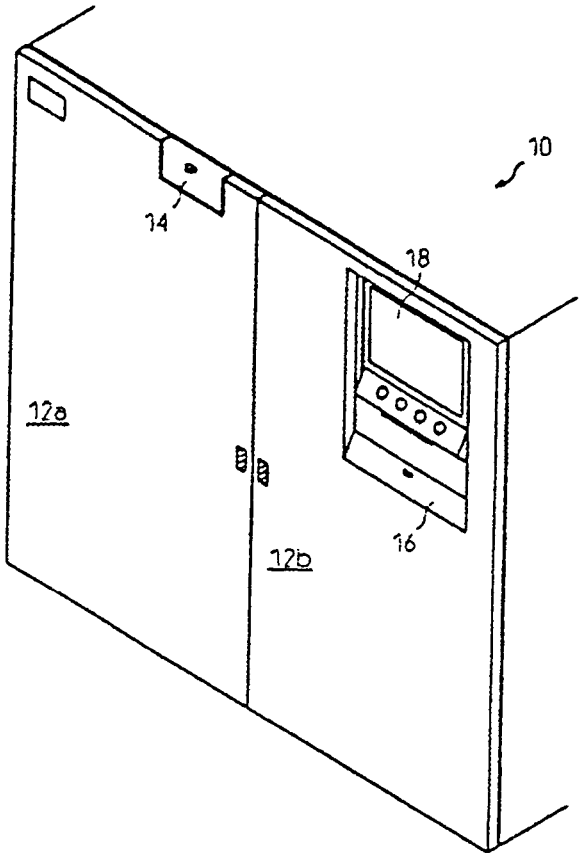
FIG. 1 is a front view of a high-performance printer with closed flaps.

FIG. 1 schematically shows the front side of a high-performance printer 10 that can print single sheets at high speed. The high-performance printer 10 contains two printing units (not shown) to each of which a respective toner reservoir from which toner is supplied to the respective printing unit is allocated. The toner reservoir essentially permanently installed in the high-performance printer 10 and must be refilled at time intervals via a filling opening 20 depended on the use. The two device doors 12*a*, 12*b* pivotable toward the outside serve the purpose of covering internal parts of the high-performance printer 10 as well as the toner reservoir. The device doors 12*a*, 12*b* are connected to an electrical security means that interrupts operations of the high-performance printer 10 when either of the doors 12*a* and 12*b* are in an open condition. In order to avoid such an interruption and nonetheless enable a refilling with toner, a respective opening closeable by flaps 14, 16 is provided in the region of the respective filling opening 20 of the two toner reservoirs, said openings not being connected to the safety system. A control panel 18 that, as described later, can be pivoted out is arranged above the flap 16.

Figure 2:
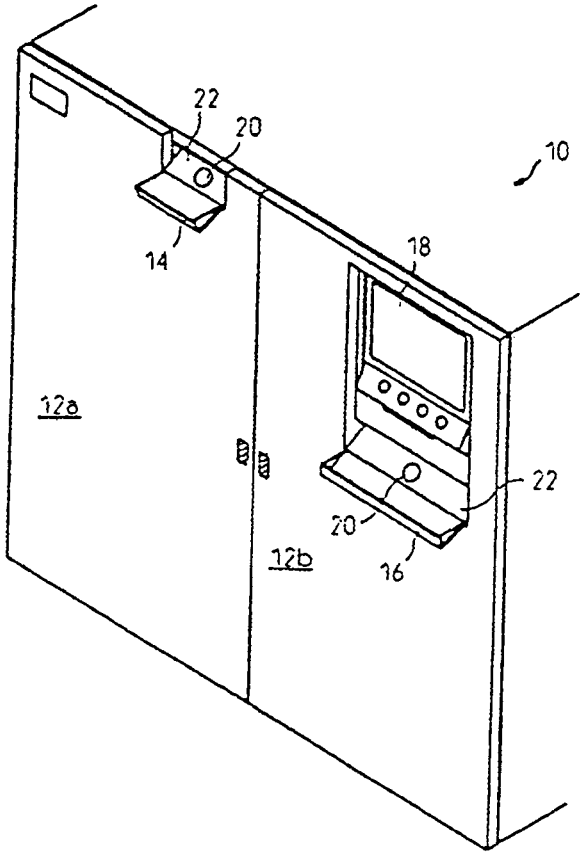
FIG. 2 is the front view of FIG. 1 with open flaps.

FIG. 2 shows the front view of the high-performance printer 10 of FIG. 1 with opened flaps 14, 16. In the opened condition of the flaps, the filling openings 20 of the toner reservoirs 22 become visible. Toner from a standardized refilling bottle can thus be refilled into the toner reservoirs 22 without opening the device door 12*a*, 12*b* and interrupting the printing operations. In the closed condition of the flap 14, 16, the internal parts of the high-performance printer 10 are again completely protected from the outside world.

Figure 3:
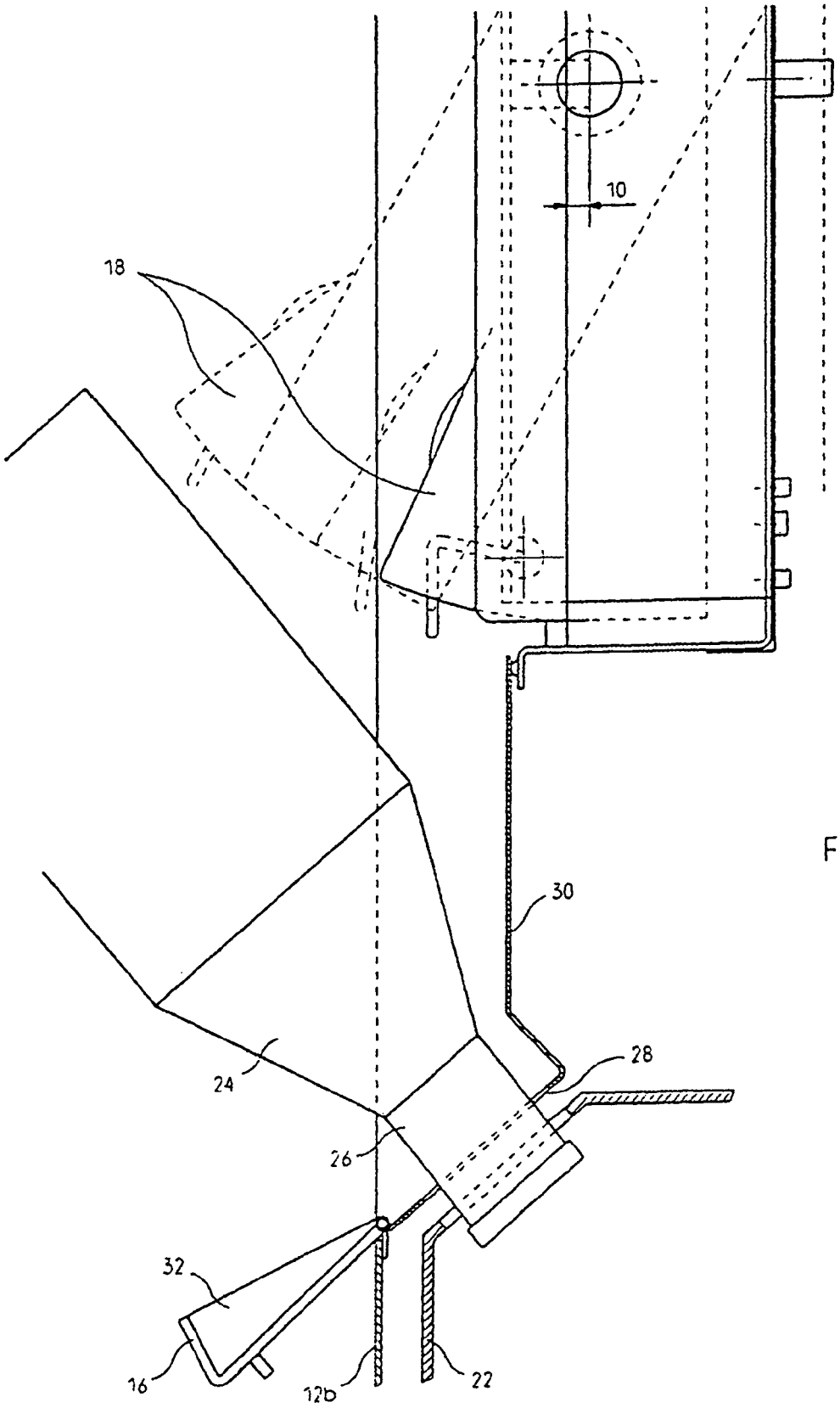
FIG. 3 is a schematic view when refilling the toner reservoir.

FIG. 3 shows the condition when refilling with a standardized toner refilling bottle 24. The refilling bottle 24 is introduced into an opening of the toner reservoir 22 through an opening 28 in the cladding panels 30 with its bottleneck 26 in an oblique position and the toner reservoir 22 is filled with toner. After the filling, the flap 16 closes the opening 28.

The flap 16 is shaped such that it defines an upwardly opened container space 32. This container space 32 serves the purpose of collecting toner that is potentially spilled during filling. The access to the toner reservoir 22 for the refilling bottle 24 is fashioned such that a spilling of toner when the refilling bottle 24 is applied can be easily avoided, and the emptying of the refilling bottle 24 can ensue unproblemmatically by the force of gravity as a result of its oblique attitude.

It can be seen in the upper part of the Figure that the operating panel 18 can be pivoted. A filling opening of the toner reservoir 22 is fashioned such that, when filling with the standardized refilling bottle 24, this can be introduced with play at the swivelled-out operating panel 18.

Figure 4:
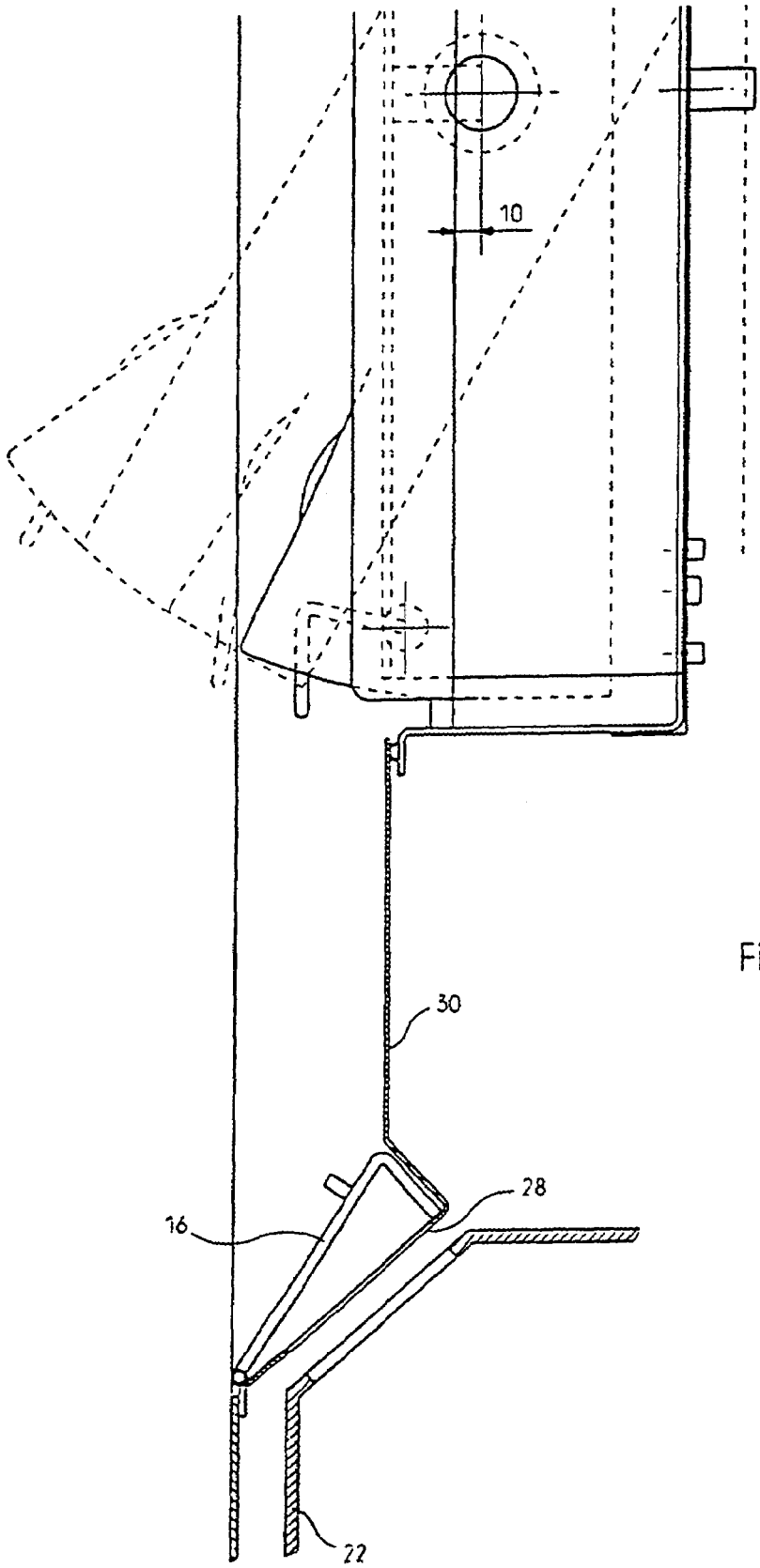
FIG. 4 is the view of FIG. 3 with closed flaps.

To facilitate an understanding, FIG. 4 shows the flap 16 in the closed condition wherein the opening 28 is completely covered.

Figure 5:
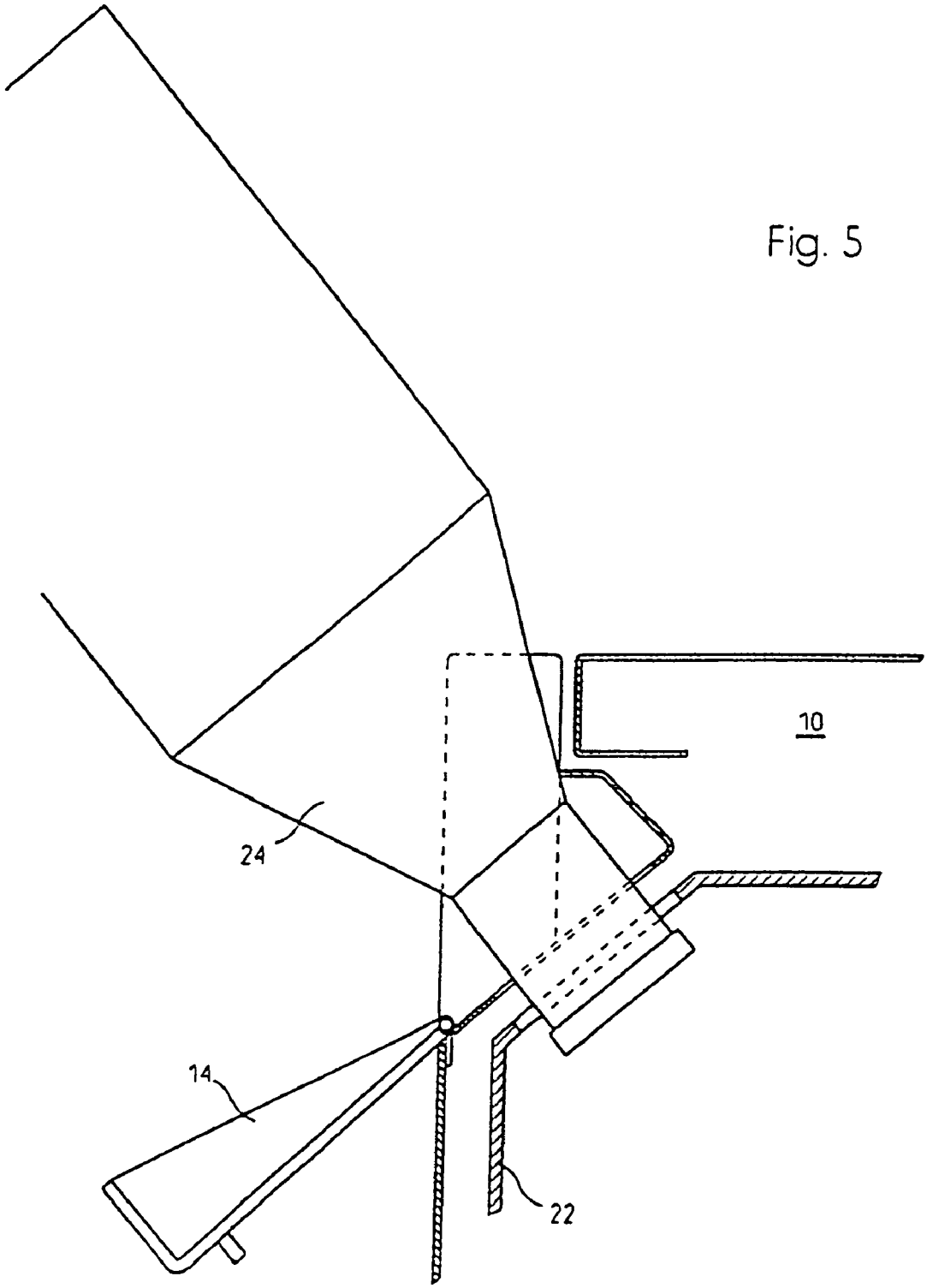
FIG. 5 is a schematic view with a flap in the proximity of the upper edge of the printer in the condition with the refilling bottle inserted.
Figure 6:
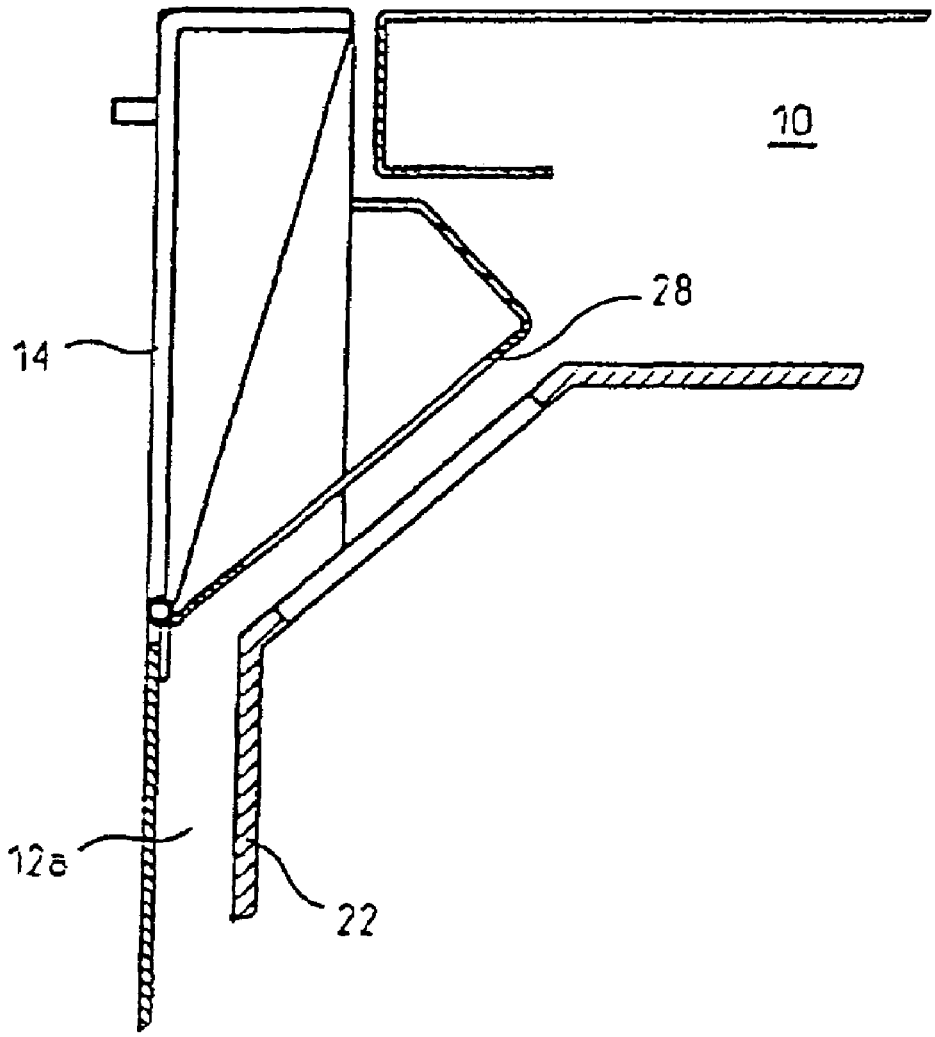
FIG. 6 is a schematic view with the upper flap of FIG. 5 in the closed condition.

FIG. 5 shows another exemplary embodiment wherein the flap 14 is arranged in the upper edge reading of the cladding of the high-performance printer 10. According to FIG. 6, it can be seen that the cuboid-shaped housing form is again completed in the closed condition of the flap 14.

Figure 7:
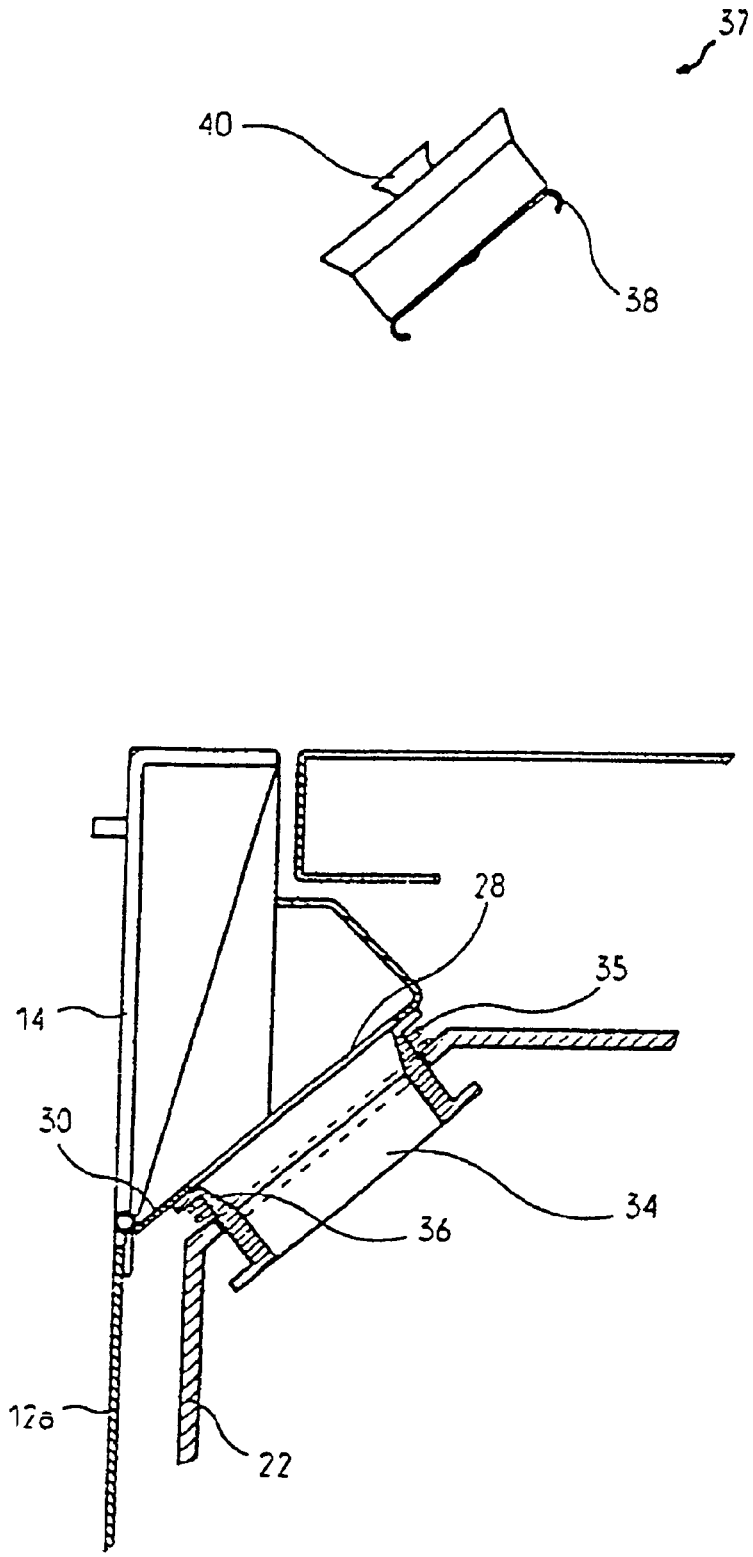
FIG. 7 is a schematic view of a toner reservoir with mouthpiece and a cap removed from the mouthpiece of the toner reservoir.

FIG. 7 shows the toner reservoir 22 as a partial excerpt. The toner reservoir 22 holds the contents of two refilling bottles each having respectively 0.6 kg of toner. Accordingly, the toner reservoir 22 has a receptacle volume of approximately 3.6 liters, whereby the tone arising during the filling procedure is to be taken into consideration as an additionally required space when designing the toner reservoir 22. A mouthpiece 34 that is fixed by a spring element 35 is introduced into the toner reservoir 22. The mouthpiece 34 has a funnel-shaped section 36 that assures that an optimally small annular gap arises between opening of the mouthpiece 34 and the refilling bottle. The center axis of the opening of the mouthpiece 34 proceeds obliquely relative to the vertical, so that the refilling bottle can be applied in an oblique attitude and a spilling of toner is avoided. The center axis of the opening of the mouthpiece 34 approximately intersects the center axis of the toner reservoir 22, this assuring that the cone is built up in the middle of the toner reservoir 22. The opening of the mouthpiece 34 is tightly closed with a closure cover 37 after the refilling. The closure cover 37 has a spring snap 38 at its underside with which, after being introduced, it engages into the mouthpiece 34 with a snap-in event. The closure cover 37 has a handle 40 at its upper side.

Figure 8:
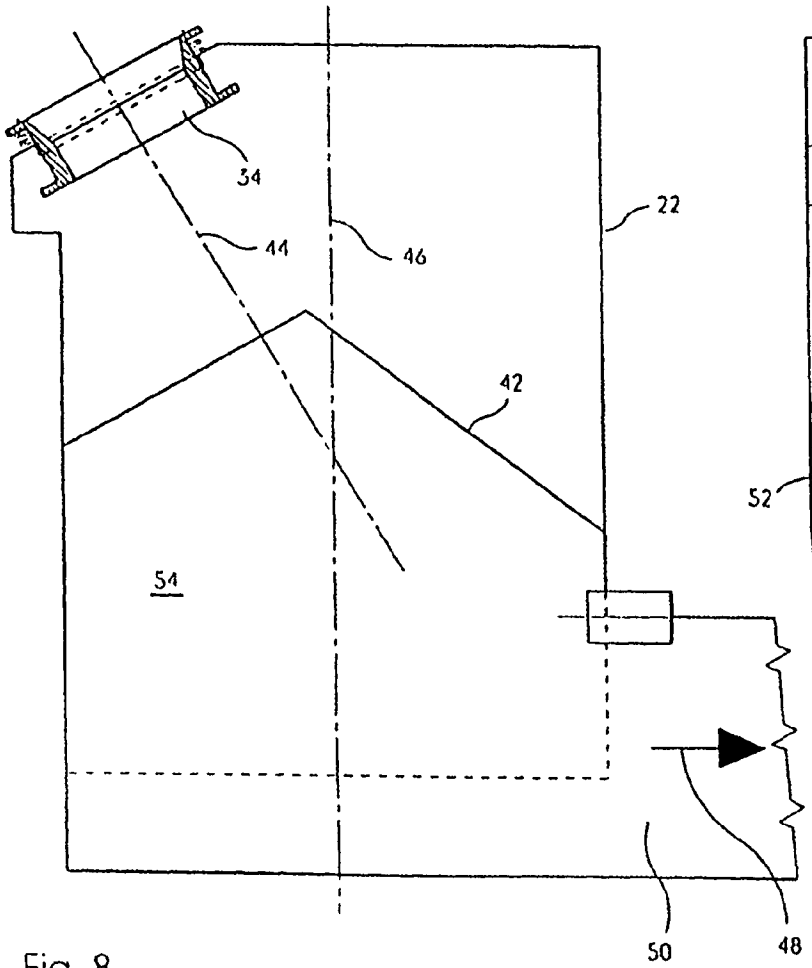
FIG. 8 is a side view of the toner reservoir.

FIG. 8 schematically shows the structure of the toner reservoir 22 from the side. The center axis 44 of the mouthpiece 34 intersects the center axis 46 of the toner reservoir at approximately half height. A channel 50 via which toner 54 is conveyed off in the direction of the arrow 48 to the printing unit is located in the lower region of the toner reservoir.

Figure 9:
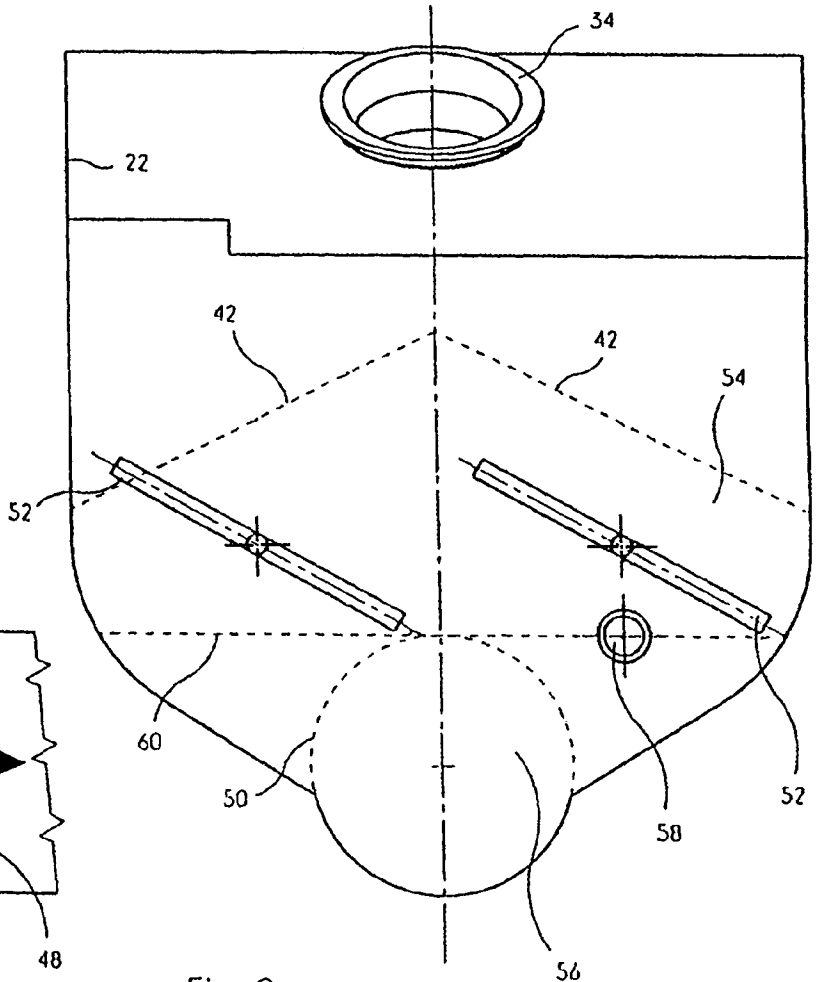
FIG. 9 is a view of the toner reservoir from the front.

FIG. 9 shows a view from the front. The mouthpiece 34 is located in the middle of the toner reservoir 22, as a result whereof a uniform delivery and an optimum, uniform emptying of the toner reservoir 22 is assured. A filling level sensor 58 emits an alarm signal when the toner 54 has reached the level 60 (hatched line). The remaining amount 56 is then still adequate in order to enable a refilling of the toner without an interruption of printing having to ensue. Two pivot arms 52 that turn oppositely toward one another see to it that toner adhering to the inside wall of the toner reservoir 22 is scraped off and a dense cone 42 arises.

Figure 10:
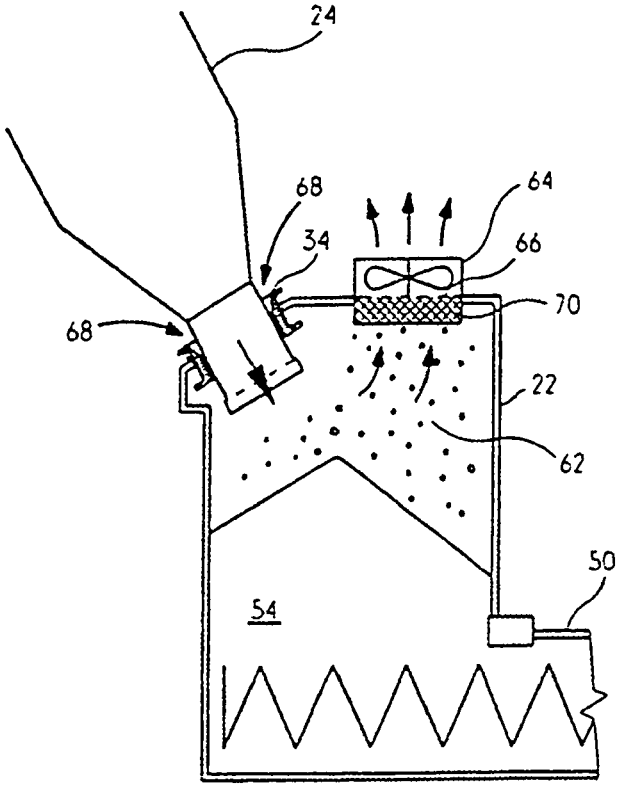
FIG. 10 is a schematic view of an arrangement for the generation of an under-pressure in the toner reservoir.
Figure 11:
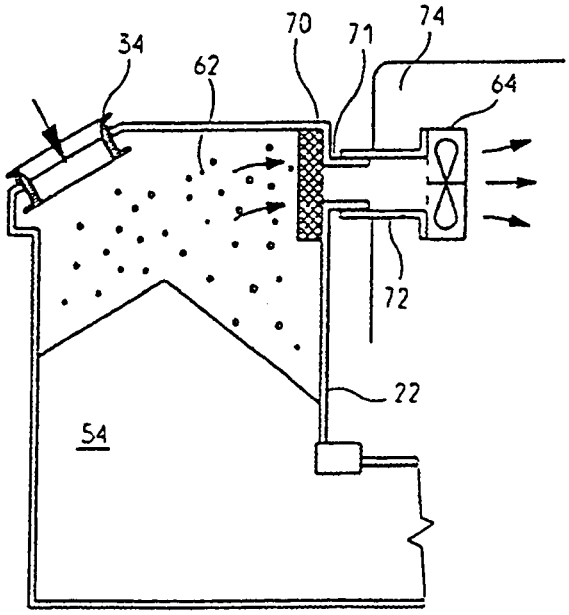
FIG. 11 is the connection of a connecting hose, shown schematically.
Figure 12:
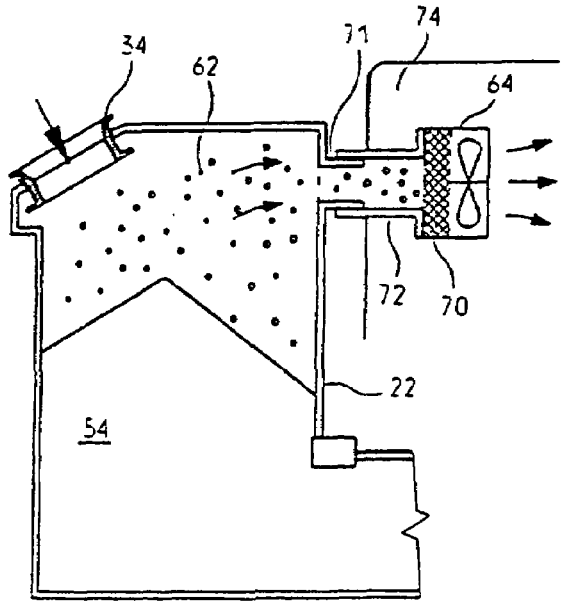
FIG. 12 is a schematic view of the arrangement of a filter outside the toner reservoir.

FIGS. 10, 11 and 12 are directed to a further aspect of the invention in accord wherewith a slight vacuum or under-pressure is generated in the toner reservoir. FIG. 10 illustrates the refilling of the toner reservoir 22. When refilling toner from the refilling bottle 24, toner dust 62 arises that can emerge from the annular gap opening at the mouthpiece 34 without further measures. Inventively, air is extracted from the toner reservoir 22 via an air elimination opening 66 with a ventilator or fan 64, at least during the filling procedure, as a result whereof air is suctioned through the annular gap at the bottleneck in the direction of the arrows 68. Toner dust 62 cannot emerge. The air elimination opening 66, according to FIG. 10, is provided with a filter 70 at the inside of the toner reservoir 22 that retains toner. The air elimination opening 66 is arranged in the upper region of the toner reservoir 22, preferably in the toner-free area.

FIG. 11 shows an alternative embodiment. A discharge connector 71 is connected to a connecting hose 72 that leads into the inside 74 of the printer. The ventilator 64 in this version is arranged in the inside 74 of the printer. FIG. 12 shows a development of the arrangement according to FIG. 11. In this development, the filter 70 is arranged in the inside 74 of the printer and not in the toner reservoir 22.

During operation of the printer, a control sees to it that the under-pressure in the toner reservoir 22 is built up no later than the beginning of the toner refilling event, this having to be retained until the end of the refilling event. For example, the start of the extraction can ensue with an electromechanical switch that is actuated when the toner reservoir 22 is opened. It is also possible to maintain the under-pressure in the toner reservoir 22 during the entire operation of the printer.

Figure 13:
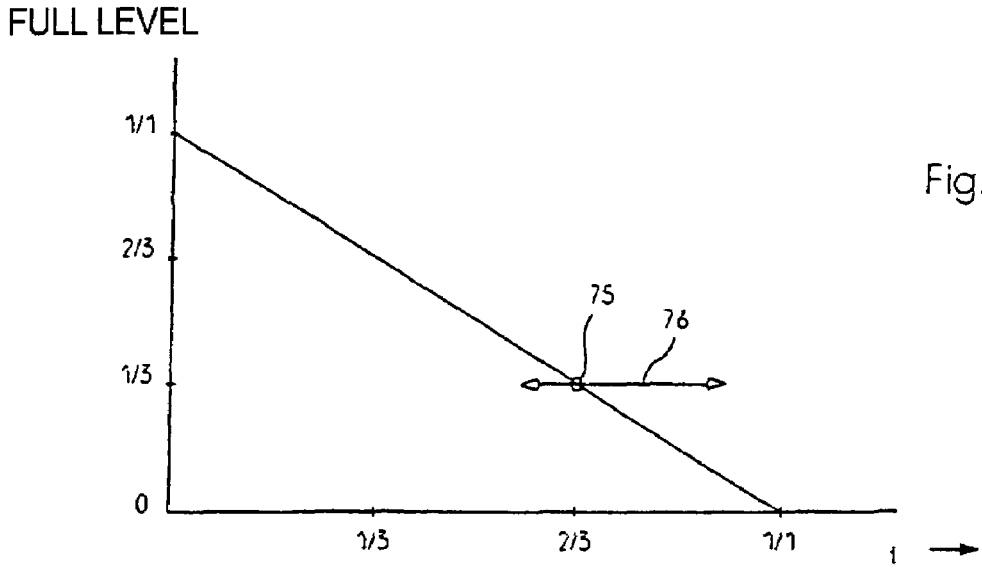
FIG. 13 is a diagram of the decrease of the amount of toner over the operating time.

FIG. 13 shows a diagram with reference whereto the decrease in the toner filling level in the toner reservoir 22 over the operating time of the printer is illustrated. The operating time is shown on the abscissa, the toner filling level is shown on the ordinate. The toner filling level 75 at which the filling level sensor 58 outputs an alarm signal is entered into the characteristic. This alarm signal means that the toner will soon run out and toner must be refilled. Within the remaining time wherein there is still adequate toner in order to maintain printing operations, an operator must replenish the toner. The position of the printing level sensor 58 can be modified, as a result whereof the range of remaining time within which the refilling can ensue without interrupting printing operations illustrated by an arrow 76 can be set. The alarm signal is preferably output when the filling level lies at 10–40% of the overall amount of toner in the toner reservoir 22. When the remaining toner is used, then the control must generate an abort signal with which printing operations are shut off. In addition to generating an abort signal after a predetermined time has elapsed, it can also be generated dependent on the use of the remaining toner. For example, the use of toner can be determined on the basis of a toner mark regulation in conjunction with a clock toner conveying. Given this toner mark regulation, a control pulse for toner conveying is output for a dosing shaft controlled step-by-step given every toner mark on the photoconductor drum of the printing unit that is inked too lightly. The time for a toner delivery, i.e. for a specific amount of toner, can be set in defined fashion per control pulse. When the remaining amount of toner will be used after the occurrence of the alarm signal can be identified from the addition of the conveying times and the dosing quantity per time unit. The abort signal can be accordingly generated. In this way, the overall time within which a refilling of toner must ensue in order to maintain operations free of printing operations can be optimally determined.

Another possibility of determining the toner use and generating the abort signal is by determining the use of toner on the basis of the printed picture elements and of the printing contrast that has been set. Of course, it is also possible to determine a specific number of pages that are still allowed to be printed after the occurrence of the alarm signal until the abort signal is generated. What is thereby disadvantageous is that the remaining time can be extremely short for the refilling, since the toner consumption is highly dependent on the degree of blackening of the printed pages.

On the basis of the current consumption of toner and the amount of refilled toner after the occurrence of the alarm signal, it is also possible to continuously determine the actual filling level in the toner reservoir 22. This actual filling level can then be displayed on a display at the printer. The level at which the filling level sensor 58 outputs its alarm signal then serves as measuring point for the actual toner filling level in the toner reservoir 22.

Figure 14:
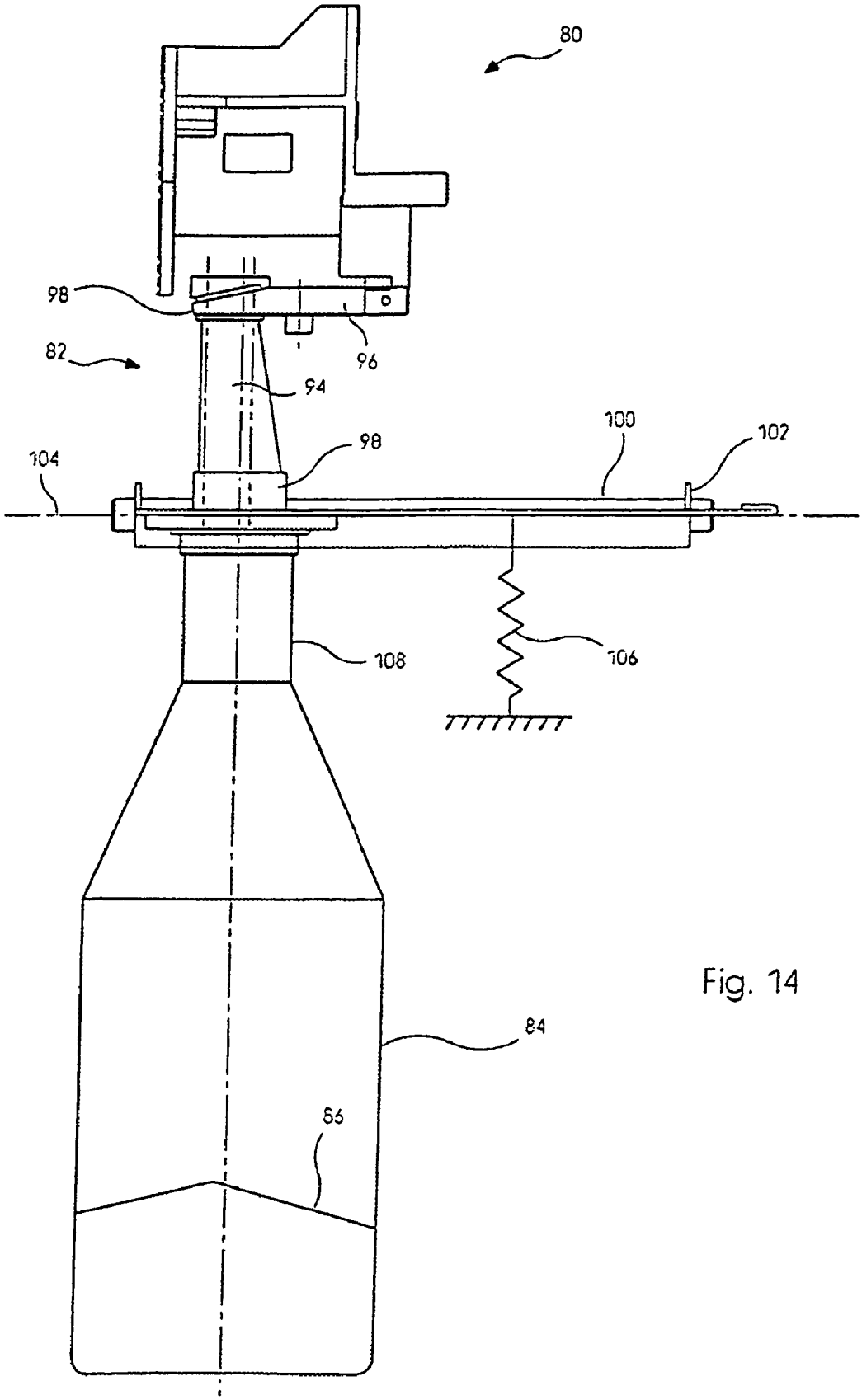
FIG. 14 is a schematic side view of the adapter unit connected to a used toner container.

The following FIGS. 14–22 are directed to means for eliminating used toner that is collected by the cleaning system in the printing unit. FIG. 14 schematically shows the elimination of the used toner output from the cleaning station 80 via an adapter unit 82 into a used toner container 84. When the bulk fill level 86 in the used toner container 84 has reached a specific height, the used toner container 84 must be replaced with an empty one. In order to enable this in a simple way, the used toner container 84 is not connected directly to the cleaning station 80; rather, the adapter unit 82 is provided as a connecting piece, which assures that the toner does not adhere to it or collect at it either due to its coercive forces or due to the residual electrical charge, which can lead to a blockage.

Figure 15C:
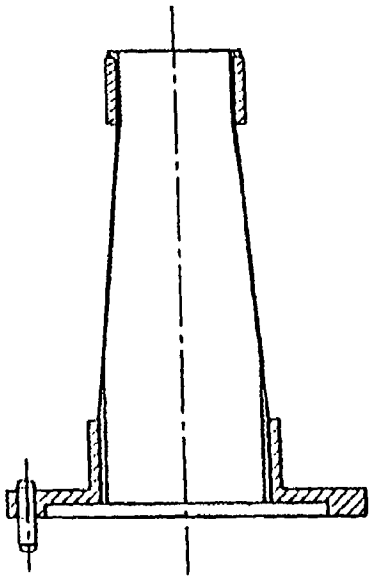
FIGS. 15A, 15B and 15C are different vies of an adapter unit with FIG. 15A being a side view, FIG. 15B being a top plan view and FIG. 15C being a cross-sectional view.
Figure 15A:
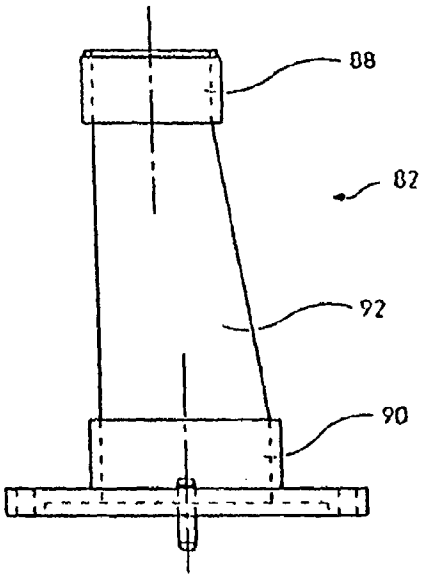
Figure 15B:
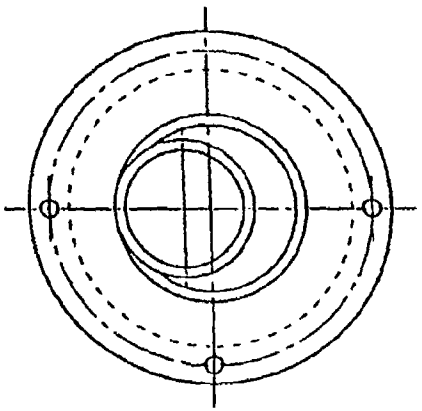

The structure of the adapter unit 82 is shown in FIGS. 15A, 15B and 15C in a side view, a plan view and in a side cross-section. The adapter unit 82 has a stable collar 88 at the side of the cleaning unit 20 that is fashioned as a rotary part. A further rotary part 90 that, as shall be explained later, is accepted in a locking plate is provided at the side of the used toner container 84. A flexible hose 92 is arranged between the collar 88 and the rotary part 90. This hose 92 is composed of silicone-containing plastic and is vulcanized into the parts 88, 90. Due to the flexibility of the hose 92, a horizontal compensation of design tolerances can ensue on the one hand; on the other hand, this hose 92 can execute vertical movements and deformations without a permanent deformation remaining. The hose 92 expands in the fashion of a conical frustum in the direction toward the used toner container. As a result thereof, a permanent collection of used toner in the hose 92 is avoided.

Figure 16A:
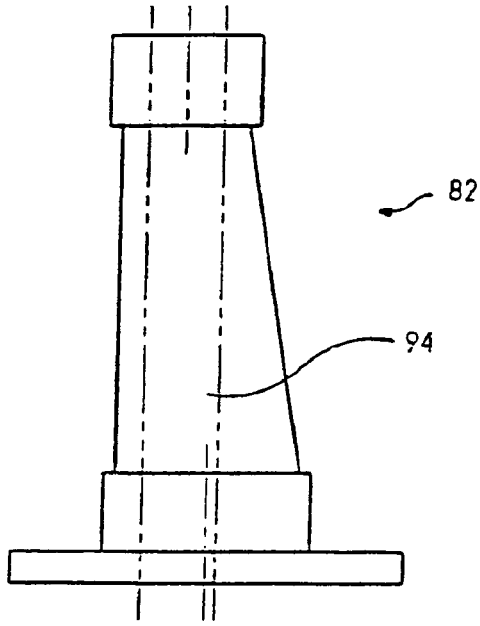
FIG. 16A is a side view of the adapter in a relaxed state.
Figure 16B:
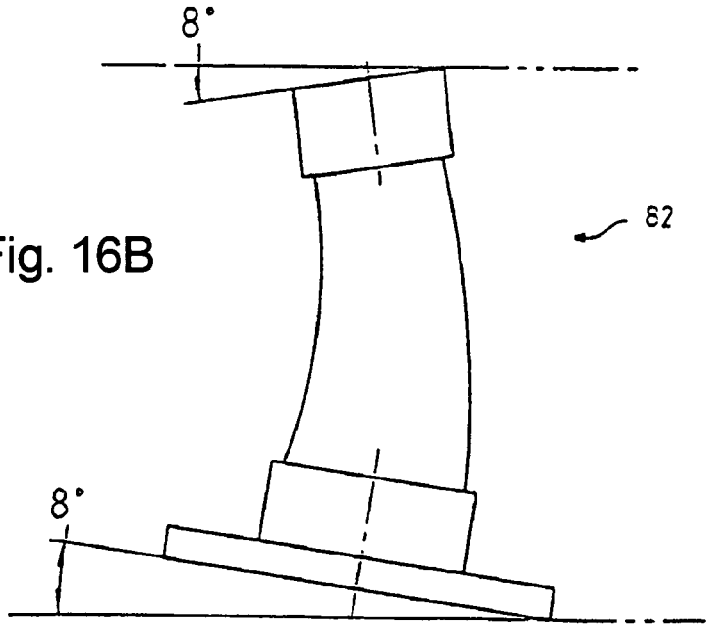
FIG. 16B is a side view of the adapter in a compressed state.

FIG. 16B illustrates the flexibility of the adapter unit 82, whereby it can execute an angular motion of approximately 8° at both ends independent of one another. In FIG. 16A, the principal; descending channel 94 wherein the used toner overcomes a descending path of approximately 100 mm is entered with dash-double dot lines, and the toner descends without a clumping of the used toner or an adhesion thereof to the inside ensuing.

Returning to FIG. 14, it can be seen that the adapter unit 82 is connected to a swivel arm 96 of the cleaning unit 80 by a clamped connection 98. The rotary part 90 is accepted in a recess of a locking plate 100 that is seated in a peg 102 to rotate in a plane 104 that resides perpendicular to the paper plane. The locking plate 100 is pre-stressed in the direction of the used toner container 84 with a tension spring 106.

Figure 17:
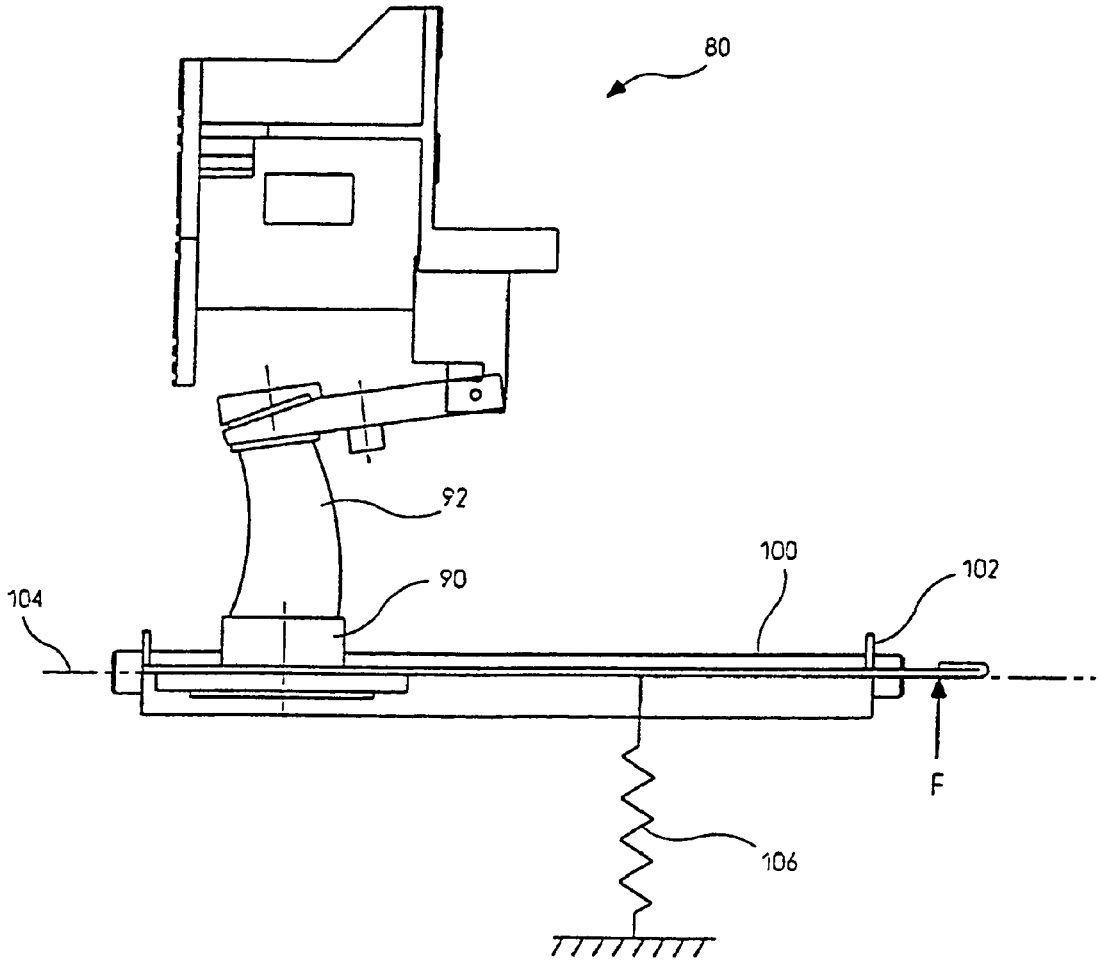
FIG. 17 is a side view of the adapter unit when replacing the used toner container.

FIG. 17 shows the adapter unit 82 and the locking plate 100 when the used toner container (not shown in FIG. 17) is being replaced. For unlocking, the locking plate 100 is pressed up upon exertion of a force F of approximately 15 N, whereby the rotary part 90 has its inside surface separating from the neck 108 of the used toner container 84 while compressing the hose 92. In this condition, the used toner container 84 can be moved out, as explained in greater detail in the following FIG. 18.

Figure 18:
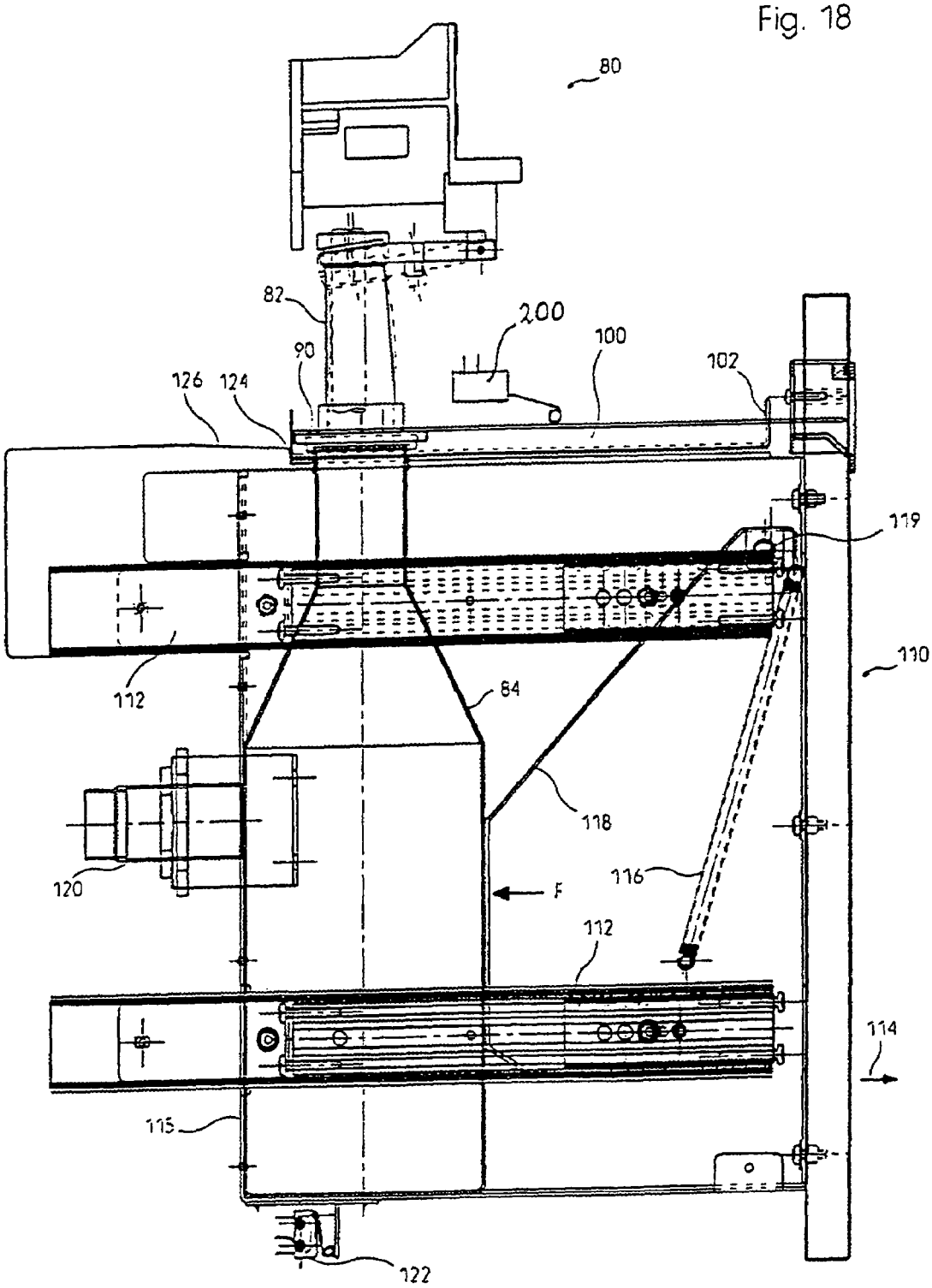
FIG. 18 is a side view of the used toner container introduced into a drawer.
Figure 20B:
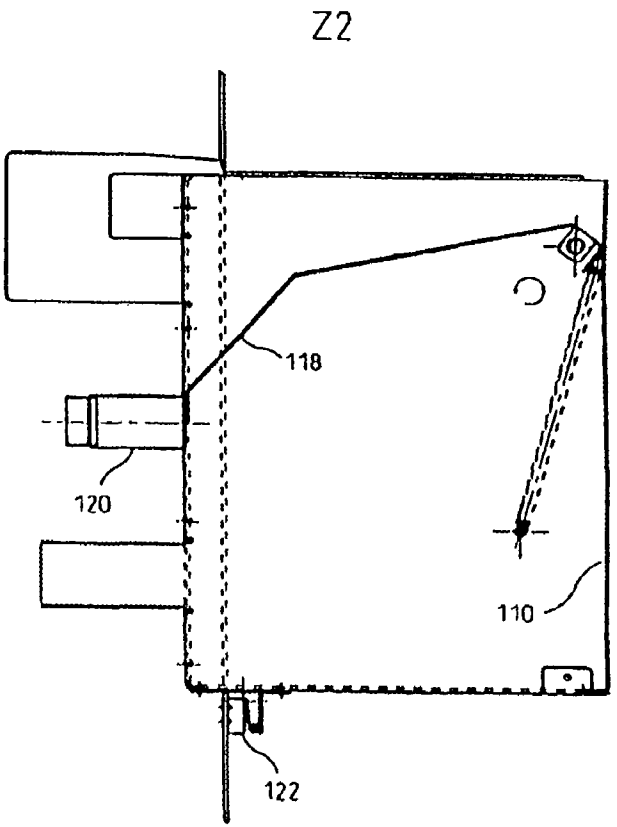
FIG. 20B is a schematic view of the drawer with the used toner container removed to illustrate the condition Z2.
Figure 20A:
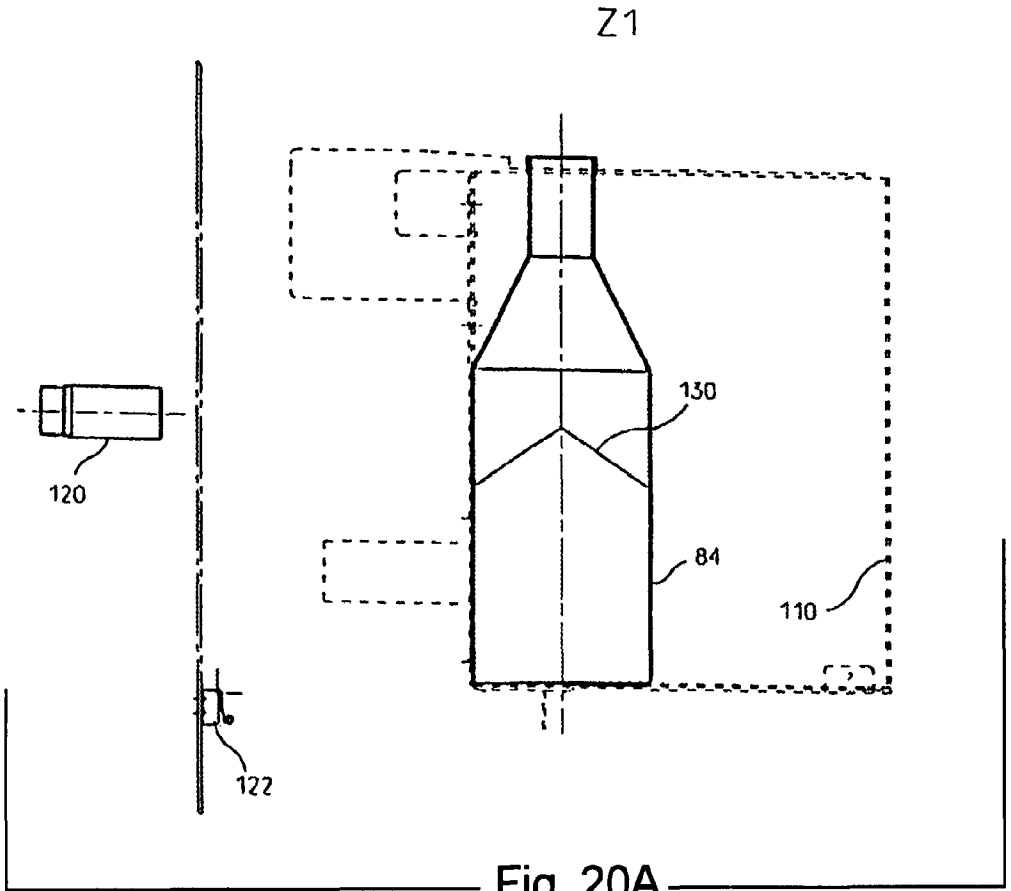
FIG. 20A is a schematic view of the drawer with a full, used toner container in an opened position to illustrate the condition Z1.

FIG. 18 shows a side view of the used toner container 84 introduced into a drawer 110. The operating condition wherein used toner is conducted into the used toner container 84 is shown. The drawer 110 is seated on telescoping rails 112 and can be pushed out in the direction of the arrow 114 in order to replace the used toner container 84. The used toner container 84 is pressed against the back wall 115 of the drawer 110 with the force F by a pivot element 118 formed of sheet metal and is thus pressed against the acquisition surface of a capacitative filling level sensor 120. The force F is derived from a tension spring 116. The pivot element 118 is pivotably seated around a pivot bearing 119. A microswitch 122 acquires the position of the drawer 110. Its signal is evaluated for monitoring, as explained in greater detail below.

In the illustrated, retracted condition of the drawer 110, the locking plate 100 engages into a stop edge 124 of a side panel of the drawer 110. For replacing the used toner container 84, as mentioned, the locking plate 100 is raised and pivoted out perpendicular to the paper plane, so that the adapter unit 82 detaches from the used toner container 84. A ramp 126 serves the purpose of assuring that the adapter unit 82 remains in a compressed condition in the withdrawn condition of the drawer 110. In this hinged-up position, the hose 92 is bent off once or repeatedly and thereby seals the adapter unit in view of the used toner. Toner particles cannot escape from the adapter unit in this condition; after the drawer has been withdrawn by about 300 mm, the full used toner container 84 can be replaced with an empty one. The new used toner container is pressed against the filling level sensor 120 by the swivel element 118, so that a stable operating position is achieved. Subsequently, the drawer 110 is again closed, this being signaled by the microswitch 122. The locking plate 100 thereby again lowers, the bend or, respectively, bends in the hose 92 released and used toner can again emerge from the adapter unit 82 into the used toner container 84. A further microswitch 200 detects the raised or, respectively, lower position of the locking plate.

For monitoring the various operating conditions during replacement of the used toner container free of printing operations, the microswitch 122, the filling level sensor 120 and the microswitch 200 are employed for signaling. The various operating conditions Z1 through Z4 are shown in FIG. 19 dependent on the signals of the two detectors 120 and 122. The filling level sensor 120 has a signal status F=0 when the used toner container 84 has a high filling level. It has the value F=1 when the filling level is low. The microswitch 122 has the value M=0 when the drawer 110 is pulled out; it has the value M=1 when the drawer is completely pushed in. The signal of the microswitch 200 is employed for checking the respectively proper position of the locking plate 100, for example whether the locking plate has been lowered, after the drawer was pushed back in. A determination can be made with this information as to whether a toner transport from the adapter unit 82 through the hose 92 is possible. When a certain amount of toner has arisen, then it must be assured that this can be eliminated from the adapter unit 82 into the used toner container.

The statuses Z1 through Z4 are defined according to the aforementioned signal statuses F and M. These various operating statuses Z1 through Z4 are graphically illustrated in FIGS. 20A, 20B, 21A and 21B In the condition Z1 (FIG. 20A), the drawer 110 is withdrawn and the used toner level 130 is high, i.e. the used toner container is to be replaced. In this operating condition, the used toner container 84 must be replaced within a predetermined changing time; otherwise, the control generates an abort signal and printing operations are suspended. Instead of the changing time, the amount of used toner that has actually arisen can also be interpreted, for example by determining the plurality of printed picture elements and of the contrast that is thereby set or by determining the amount of conveyed toner.

In the status Z2, the pivot element 118 swivelled against the filling level sensor 120 simulates a full used toner container. The drawer 110 is closed and the microswitch 122 is actuated. When no used toner container is introduced within a predetermined time given this operating condition, then printer operations are suspended.

Figure 21B:
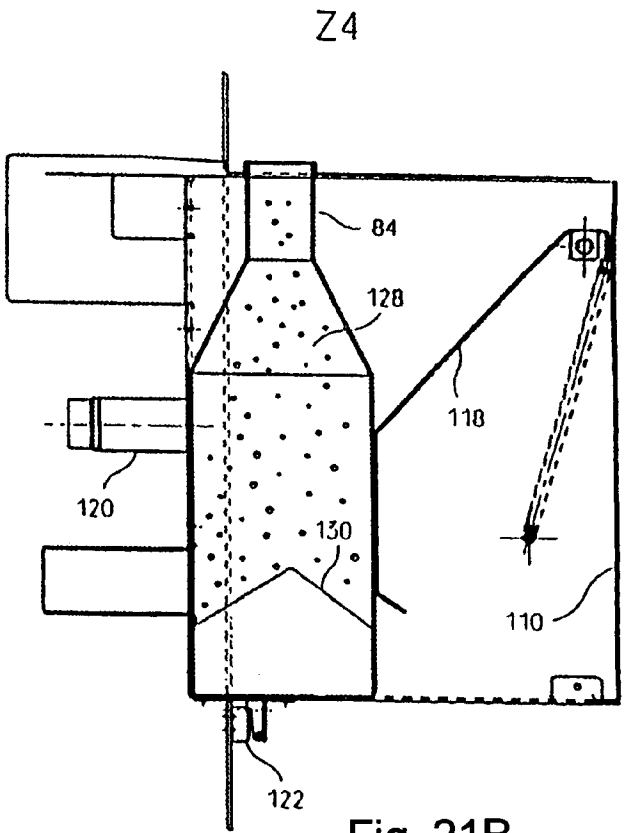
FIG. 21B is a schematic view of the drawer in a closed position and the container no yet full to illustrate the condition Z4.
Figure 21A:
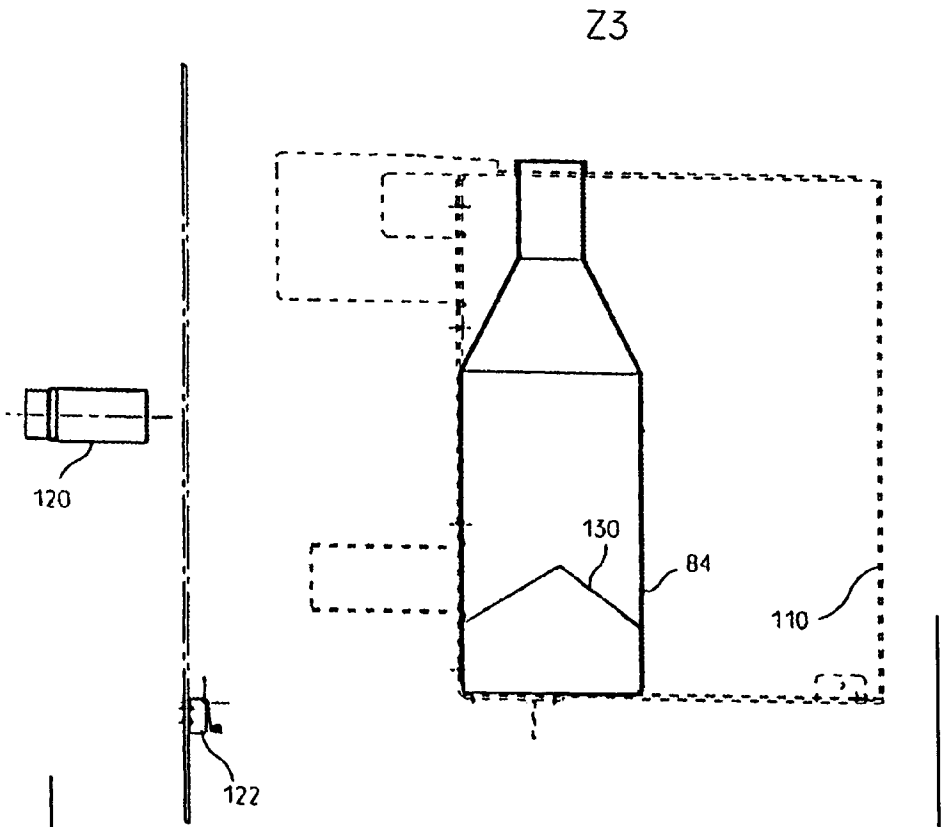
FIG. 21A is a schematic view of the drawer with a partially filled, used toner container in the opened condition to illustrate the condition Z3.

In the operating status Z3 according to FIG. 21A, the drawer 110 is opened and the filling level sensor 120 indicates that the used toner level 130 still lies below the full level. When the drawer is not closed within a predetermined time given this operating condition, then printer operations are suspended.

The operating status Z4 defines the printing mode without malfunction. The drawer 110 is closed and the capacitative filling level sensor 120 indicates that the used toner level 130 is low and the used toner container 84 can still accept an adequate quantity of used toner.

By evaluating the signal statuses F and M of the sensors 120 and 122, the control of the printer can reliably control printing operations and monitor the replacement of the used toner container free of printing operations in all operating conditions.

Figure 22:
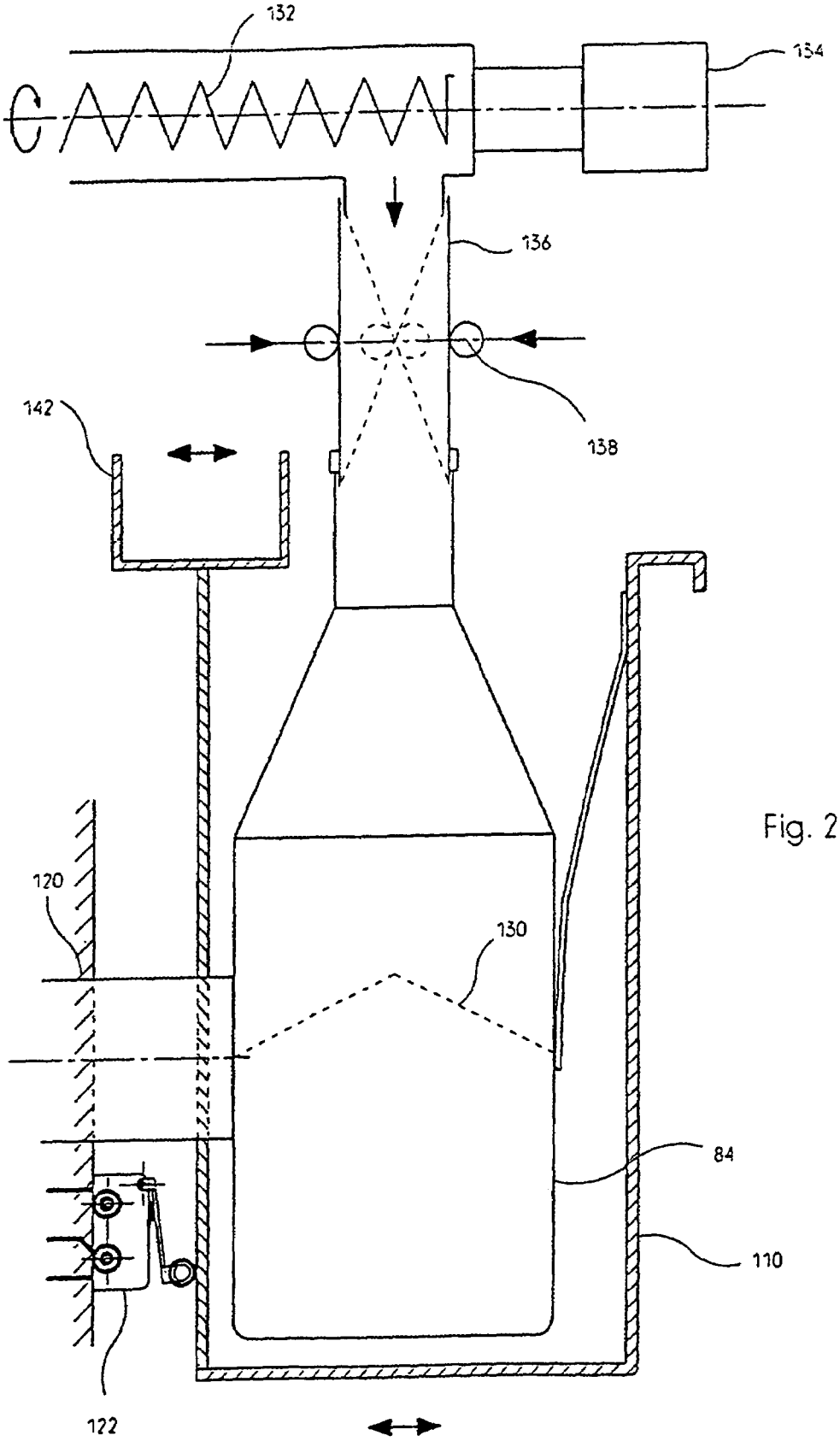
FIG. 22 is a schematic side view of further exemplary embodiments for a replacement of the used toner container without interrupting printing operations.

FIG. 22 shows further possibilities for the replacement of the used toner container without having to interrupt printing operations. What is critical for the replacement of the used toner container free of printing operations is that the filling level sensor 120 outputs a full signal at a status when there is still adequate space for toner and there is still adequate time remaining in order to undertake steps for the replacement of the used toner container 84. When the remaining time until the full condition of the used toner container 84 is exceeded, then the control must immediately arrest printer operations in order to prevent an overfilling of the used toner container 84 and a possible toner jam. The remaining time can be determined on the basis of printed pages or the time can be fixed dependent on the occurrence of used toner. The occurrence of used toner derives from the transfer printing efficiency and can be exactly determined by the control, for example, on the basis of the printed picture elements in conjunction with the transfer printing efficiency and the printing contrast. In this version, the time until the replacement of the used toner container has been completed is maximum.

In order to be able to undertake the replacement of the used toner container during ongoing printer operation, the used toner that arises must be collected in the interim. FIG. 22 shows various measures as alternative or combined possibilities. The used toner conveyed by a conveyor 132 proceeds into the used toner container 84 via an adapter hose 136 in the normal operating condition. The conveyor 132 is driven by a drive 134. When a controllable coupling is inserted between this drive 134 and the conveyor 132, the conveyor 132 can be at a standstill during the replacement of the used toner container 84. The used toner arising during the replacement then remains in the conveying channel of the conveyor 132.

Another possibility is comprised in arranging a closure 138 at the level of the flexible adapter hose 136, this closure 138 being actuated for replacing the used toner container. Further, an intermediate container 142 can be provided that replaces the used toner container 84 while the used toner container 84 is being replaced and collects the used toner. The operation of the controllable coupling, of the intermediate container 142 or of the closure 138 can be controlled via the microswitch 122 that determines the withdrawal of the drawer 110. Dependent on the signal of the microswitch 122, the corresponding actuators can then be activated.

We claim:

1. Device for an electrophotographic production of image patterns on a recording medium, comprising at least one printing unit to which toner is supplied, elimination means for transferring used toner collected from a cleaning station to a used toner container, said means being interruptible in order to enable a replacement of the used toner container free of printing interruptions, and said means having a controllable coupling, which can be actuated during replacement of the used toner container, being connected between a drive and a conveyor shaft of the means for toner elimination from the cleaning station.

2. Device according to claim 1, wherein the used toner is transported between cleaning station and used toner container via an adapter unit with a conveyor through a conveying channel; and wherein used toner arising during the replacement of the used toner container is intermediately stored in the conveying channel.

3. Device according to claim 2, wherein the adapter unit comprises a flexible hose.

4. Device according to claim 3, wherein the emergence of the used toner from the adapter unit is preventable with the flexible hose.

5. Device according to claim 4, wherein a closing mechanism that is actuated for replacing the used toner container is arranged at the flexible hose.

6. Device according to claim 3, wherein the flexible hose has a material at its inside that is impenetrable for a toner and is toner-repellant; and in that it is preferably manufactured of silicone.

7. Device according to claim 3, wherein the flexible hose expands conical frustum-shaped in the direction toward the used toner container.

8. Device according to claim 3, wherein the adapter unit has a stable collar at the side of the cleaning station for acceptance in the cleaning station and has a stable receptacle at the side of the used toner container that is connected to a pivotable locking plate, whereby the flexible hose is held in the collar and in the receptacle.

9. Device according to claim 2, which includes an intermediate container that can be pivoted in against the adapter unit instead of the used toner container during the replacement of the used toner container.

10. Device according to claim 1, wherein the used toner container is accepted in a drawer seated in running rails, preferably telescoping rails.

11. Device according to claim 10, wherein, when the drawer is pulled out, a locking plate has an end facing away from its pivot point rising up on a ramp while compressing a flexible hose of the coupling and the locking plate engages behind a stop edge when the drawer is pushed in.

12. Device according to claim 10, wherein the drawer contains a pivot element pre-stressed with a spring that, when the used toner container is in its introduced condition, presses this against a filling level sensor; and in that the pivot element is pivoted against the filling level sensor in the status without introduced used toner container and simulates a fully filled used toner container.

13. Device according to claim 12, wherein the filling level sensor is a proximity sensor that outputs a full signal given a filling height of the used toner corresponding to the position of the proximity sensor.

14. Device according to claim 10, wherein a microswitch monitors the position of the drawer.

15. Device according to claim 14, which includes a control to evaluate the signal statuses of a filling level sensor and of the microswitch in order to control the replacement of the used toner container and printing operations of the device.

16. A device according to claim 1, which includes a toner reservoir with a filling opening for each printing unit being permanently installed in the device, a lockable door for covering the internal parts of the device and the toner reservoir, electrical safety means to stop operation of the printing unit when the door is opened, the door having a closable opening adjacent the filling opening so that the reservoir can be filled without opening the door to stop the operation of the printing unit.

17. Device according to claim 16, wherein the opening can be closed by a pivotable flap secured in the door.

18. Device according to claim 17, wherein the flap is fashioned so that it forms a collecting container for toner in the opened condition.

19. A device according to claim 16, wherein the filling opening of the reservoir has a releasable mouthpiece.

20. A device according to claim 16, which includes means for generating a slight under-pressure in the toner reservoir during a filling procedure.

21. A device according to claim 20, wherein the means for generating a slight under-pressure includes the reservoir having an air elimination opening with a filter to retain the toner in the reservoir.

22. A device according to claim 16, which includes the toner reservoir having a filling level sensor to determine the filling level, said sensor generating an alarm signal when the filling level drops below a set position, and means to create an abort signal for the operation of the printing unit at a period after the alarm signal.

23. A device according to claim 22, wherein the level sensor is a capacitative sensor being mounted for displacement in an axial direction on an outside wall of the reservoir and generating the alarm signal when the level falls below the sensor, said means to create an abort signal depends on the use of the toner after the alarm signal.

24. Device according to claim 23, wherein the toner use is identified on the basis of printed picture elements and of a printing contrast that has been set and/or on the basis of a number of printed individual pages.

25. A method for changing a used toner container in an apparatus for an electrophotographic generation of image patterns on a recording medium, said apparatus having at least one printing unit to which toner is supplied, a cleaning station for cleaning used toner therefrom, and means for eliminating used toner from the cleaning station to a toner container, said method comprising the steps of interrupting a flow of toner in said means for eliminating, and replacing the used toner container without interrupting a printing operation of the printing unit.

26. A method according to claim 25, wherein the means for eliminating includes a controllable coupling between a conveyor shaft and a drive of the means for eliminating, and said step of interrupting includes actuating the controllable coupling to stop the flow in the means for eliminating.

27. A method according to claim 25, wherein the means for eliminating includes a conveying channel and an adapter unit, and wherein the step of changing the toner container includes storing used toner in said conveying channel.

28. A method according to claim 27, wherein the step of storing includes closing the adapter unit while changing the toner container to prevent the emergence of used toner from the adapter unit.

29. A method according to claim 27, wherein the apparatus includes an intermediate container mounted for movement between a position adjacent the adapter unit to receiving used toner from the adapter unit, and said method of storing includes shifting the intermediate container to a position under the adapter unit to receive the used toner as the used toner container is being replaced.

* * * * *